United States Patent [19]

Pike

[11] Patent Number: 4,967,521

[45] Date of Patent: Nov. 6, 1990

[54] ANTI-PONDING RISER AND EDGE FLASHING

[76] Inventor: Robert Pike, 999 NW. 53rd Ct., Fort Lauderdale, Fla. 33309

[21] Appl. No.: 468,769

[22] Filed: Jan. 23, 1990

[51] Int. Cl.[5] ..... E04D 13/15

[52] U.S. Cl. ..... 52/95; 52/58; 52/94

[58] Field of Search ..... 52/58, 94, 95, 96, 97

[56] References Cited

U.S. PATENT DOCUMENTS 3,967,419 7/1976 Robinson ..... 52/95
4,418,505 12/1983 Thompson ..... 52/96

FOREIGN PATENT DOCUMENTS 8502893 5/1987 Netherlands ..... 52/94

*Primary Examiner*—Michael Safavi
*Attorney, Agent, or Firm*—Malin, Haley, McHale, DiMaggio & Crosby

[57] ABSTRACT

The instant invention is comprised of a combination anti-ponding riser member integrally connected to an edge flashing member, the combination being adapted for mounting along the eave course of a tile roof system. The combination, which forms an article, is comprised generally of a first, roof decking connection member adapted to be connected to the roof decking, a second sloping ramp section adapted to be disposed at an angle relative to horizontal to allow water to drain over it and off of the roof, a riser member of suitable height to support the eave course roof of tile at the desired pitch, a second roof decking contact member preferably parallel to the first roof decking connection member and an eave flashing and drip member angled relative to said second roof decking connection member to direct any runoff water away from the eave of the structure to avoid water soaking thereof and consequent damage. The article may be extruded as a continuous member and may have sealed end sections where appropriate, and may also be bent or configured to conform to shapes and angles as desired.

3 Claims, 2 Drawing Sheets

ANTI-PONDING RISER AND EDGE FLASHING

BACKGROUND OF THE INVENTION

1. Field of the Invention

This invention relates to the drainage of water off of a tile or shingle roof, and more particularly relates to a device to enhance the runoff of water passing below the roof covering at the edge of the roof nearest the facia.

2. Description of Related Art

Many buildings have tile roofs. Typically, the tiles rest upon a thin layer of sealant material such as tar paper which in turn rests on a layer of plywood decking attached to the roof trusses or rafters. When positioned on the roof, these tiles or shingles have an upper edge toward the peak of the roof and a lower edge or nose toward the eave. The upper edge is fastened to the roof either directly by nailing or some other form of direct affixation or may be formed with a lip that rests on and is supported by battens attached to the roof which run parallel to the eave line of the roof. In this way, parallel rows of tile are formed across the roof. The nose end of each tile rests atop the upper edge of the next lower tile in overlapping fashion, as seen in FIG. 1. Therefore, it can be seen that the lower edge of a tile in a parallel row is raised above the roof decking by a distance equal generally to the thickness of the next lower tile. When several rows of tile have been laid in this manner, the plane in which each respective row of tile is parallel to the others. This gives a pleasing visual appearance to the roof and allows water to run down over the tiles and off of the roof due to the overlap of tile. The lowermost row of tile (i.e.: at the eave), lacking a next lower row to support its lower edge, will lay at a non-parallel angle to the previously laid rows unless its nose is supported, creating an undesired visual appearance. For this reason, as tiles are laid down toward the edge of a roof, a "starter strip" such as rubber strip 12 in FIG. 1 has been placed along the edge of the roof at or near its lowest point to raise the lower edge of the lowermost row of tile so that the plane in which this lowermost row of tile lays will also be parallel with the other rows of tile making up the roof.

A typical starter strip is shown in U.S. Pat. No. 4,418,505 issued on Jan. 13, 1982 to Thompson. The Thompson patent provides a metal starter strip that elevates the lower edge of the tile or shingle away from the decking surface. A problem with the starter strip of Thompson which commonly arises is that water often becomes trapped by the starter strip and accumulates, commonly referred to as "pooling" or "ponding". This accumulated water invariably works its way through the sealant material and into the plywood decking layer of the roof and the eave, causing wood rot and consequent structural failure and leakage. Drain holes such as 18 in FIG. 1 are often drilled along the starter strip to allow the water to drain, but because the size of a drain hole 18 is necessarily limited by the dimensional and strength characteristics of the starter strip, the drainage holes become easily and quickly plugged by debris, rendering them useless and leaving the same ponding problem.

An additional problem exists in that the starter strip 12 typically consists of a single resilient projection extending upward from the decking material, and hence is equipped for supporting only tiles of comparatively light weight. Heavy weight tiles cause the starter strip to bend or deform, thus no longer positioning the lowermost row of tile at the desired angle. A device is needed which can support such heavy as well as light tiles and provide efficient water drainage.

In addition, no device currently available combines a flashing strip-type water deflection means for deflecting water away from the eave after said water runs off of the roof tile and/or decking surface with a tile nose riser that is strong enough to support heavy tiles and allow for efficient drainage of water out of the water ponding area.

SUMMARY OF THE INVENTION

The instant invention is comprised of a combination anti-ponding riser member integrally connected to an edge flashing member, the combination being adapted for mounting along the eave course of a tile roof system. The combination, which forms an article, is comprised generally of a first, roof decking connection member adapted to be connected to the roof decking, a second sloping ramp section adapted to be disposed at an angle relative to horizontal to allow water to drain over it and off of the roof, a riser member of suitable height to support the eave course roof of tile at the desired pitch, a second roof decking contact member preferably parallel to the first roof decking connection member and an eave flashing and drip member angled relative to said second roof decking connection member to direct any runoff water away from the eave of the structure to avoid water soaking thereof and consequent damage.

The article may be extruded as a continuous member and may have sealed end sections where appropriate, and may also be bent or configured to conform to shapes and angles as desired.

It is a principal object of the instant invention to provide an article adapted to be mounted to the eave course of a tile or roof system to support the nose ends of the eave course tiles at the desired pitch to orient said eave course tiles parallel to the other tiles of the roof system and to provide a means for draining runoff water running beneath said tiles without using drainage holes.

It is another object of the instant invention to provide an article to support the nose ends of eave course tiles in combination with an eave drip member in a tile roof system that is simple to manufacture and of one piece design.

It is a further object of the instant invention to provide an article for supporting the nose ends of the eave course row of tile of a tile roof system while permitting runoff water flowing beneath said tile to drain without using drainage apertures in said article and to thereby avoid the hazard associated with said apertures becoming clogged or blocked.

In accordance with these and other objects which will be apparent hereinafter, the instant invention will now be described with particular reference to the accompanying drawings.

DETAILED DESCRIPTION OF THE PREFERRED EMBODIMENT

Figure 1:
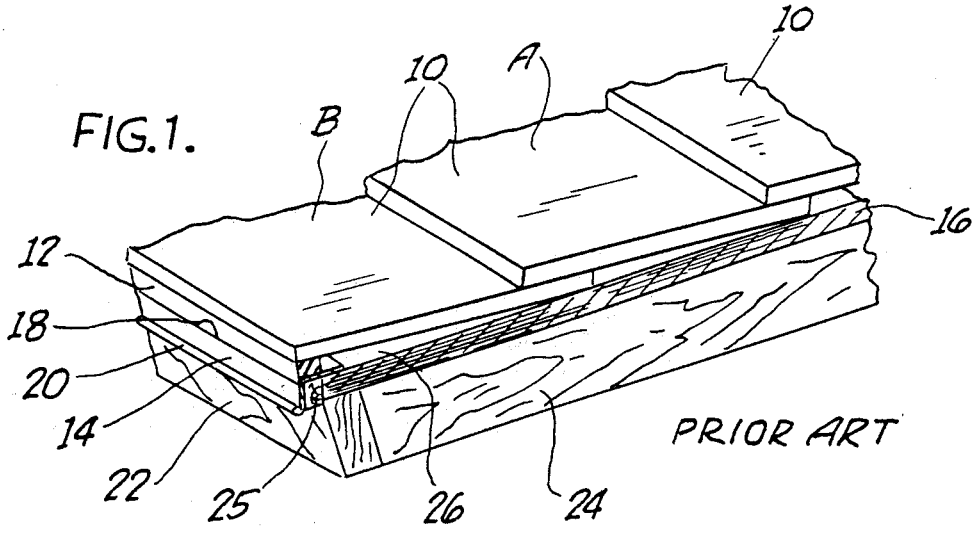
FIG. 1 shows a typical roof tile/starter strip configuration well known in the prior art.

FIG. 1 shows a representative embodiment of a roof system employing roof tiles 10, the lowermost row of which is supported at the desired angle by a starter strip or eave closure 12 mounted atop a flashing strip 14, said flashing strip 14 being mounted to roof decking means 16 at the eave 22. At spaced intervals along eave closure means 12 are through holes or "weep" holes 18, designed to allow runoff water flowing below the layer of roof tiles to drain therethrough so as not to accumulate and cause rotting, etc. Water draining through said weep holes 18 is deflected from contacting eave 22 through the use of a projecting drip edge 20, commonly referred to as an eave drip, allowing the water to simply fall to the ground.

The leading edge or "nose" A of roof tile member 10 overlaps the trailing edge B of the next lower roof tile member 10, supporting one over the other in parallel relationship. In order to support the leading edge of the lowermost roof tile member 10, starter strip 12 is used. Because it is very common for water to find its way under the layer of roof tiles, in which case it must be given the opportunity to drain, said weep holes 18 are provided. However, the weep holes 18 are of relatively small dimension due to the small size of the starter strip itself. Consequently, the weep holes 18 are easily clogged, causing an undesired ponding of water under the roof tiles behind the starter strip 12. Tar paper or other waterproof roof deck lining means 26 is typically employed but has proven to be unsatisfactory in holding off water leakage or seepage in the presence of ponding over the long run.

To remedy the above mentioned shortcomings, there is disclosed herein a combination anti-ponding riser member integrally connected to an edge flashing member, collectively referred to by the reference numeral 29, the combination being mounted along the eave course of a tile roof system. Article 29 is preferably constructed of a rigid metallized material, but may be made of plastics or metal coated with plastic and is preferably a continuous one-piece unit. Article 29 is comprised generally of a first, roof decking connection member 34 adapted to be disposed in generally parallel relationship atop the roof decking 16, a second sloping ramp section 36 adapted to be disposed at an angle relative to horizontal to allow water to drain over it from right to left in FIG. 3, a riser member 30 of suitable height to support the lowermost or eave course row of tile 10 at the desired pitch, a second roof decking connection member 38, an eave flashing member 39 angled relative to said second roof decking connection member 38, and an eave drip member 32 integrally connected to said eave flashing member 39, said eave drip member 32 being angled relative to said eave or facia member 22 so as to direct any run off water away from said eave 22. The point at which the eave course tile contacts article 29 may be referred to as the roof tile contact or connection section, which is disposed between ramp 36 and riser 30. In the preferred embodiment, the angle between ramp 36 and riser 30 is less than 90 degrees, although it may also be greater than 90 degrees but less than 180 degrees.

Tile members 10 may be of any desired design or material, and may have interlocking means associated therewith to facilitate the securement thereof to a roof system. In the preferred embodiment, shown in FIG. 2, at least the eave course tiles 10 are provided with elongated grooves 11 so that water running over ramp section 36 will be free to pass between the bottom surface of tiles 10 and the tile contact section of article 29 without undue impediment to drainage flow.

Figure 2:
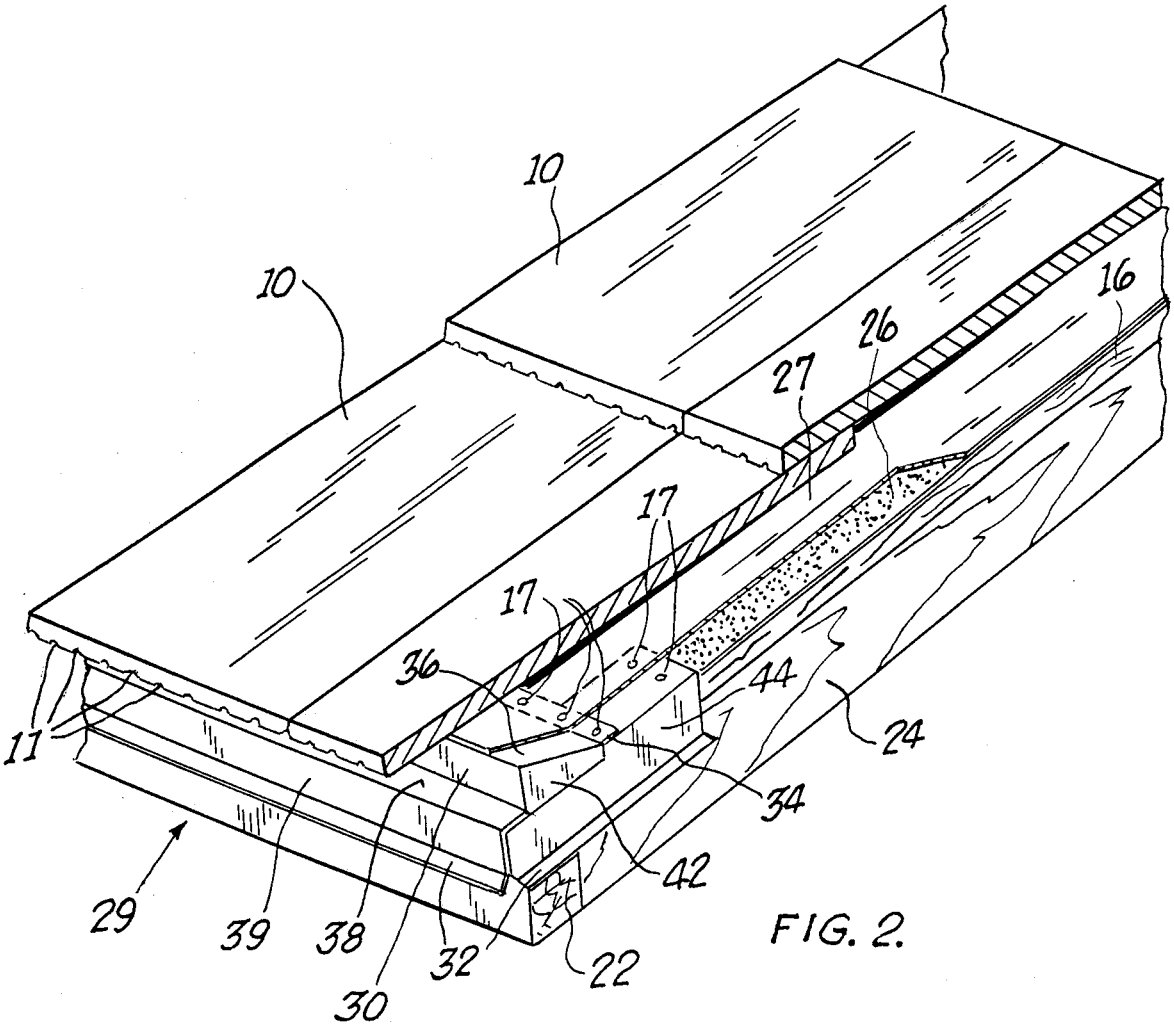
FIG. 2 a perspective view of the instant invention applied in roof decking/eave arrangement.

As can be appreciated from FIG. 2, the anti-ponding member 29 may be terminated as desired, as where a roof section ends at a vertical plane, by any convenient manner, such as vertical end plate 42. An additional edge flashing member 44 and eave drip member 46 may be utilized at such a terminus to ensure the continued strength of the underlying decking material over time.

Figure 3:
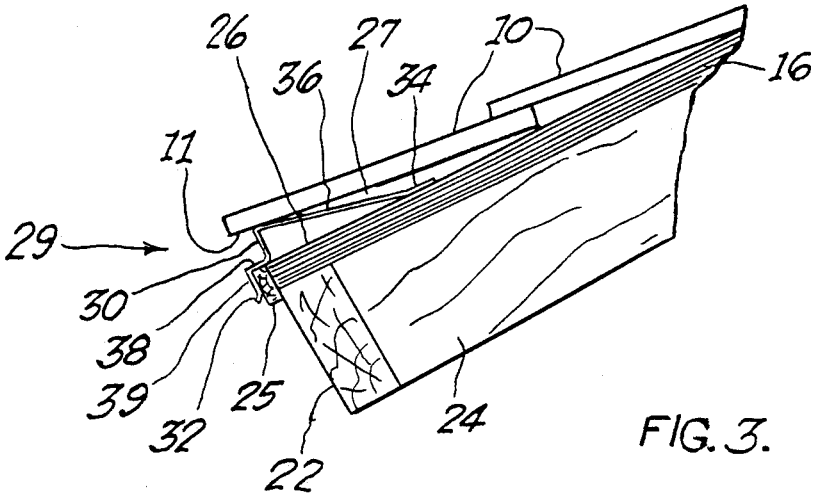
FIG. 3 a cross-sectional elevational view illustrating the invention supporting a lower roof tile at the desired pitch near the eave.

As shown in FIGS. 2 and 3, the eave course row of tiles 10 may extend relative to riser member 30 any desired distance or be coterminus therewith.

Figure 4:
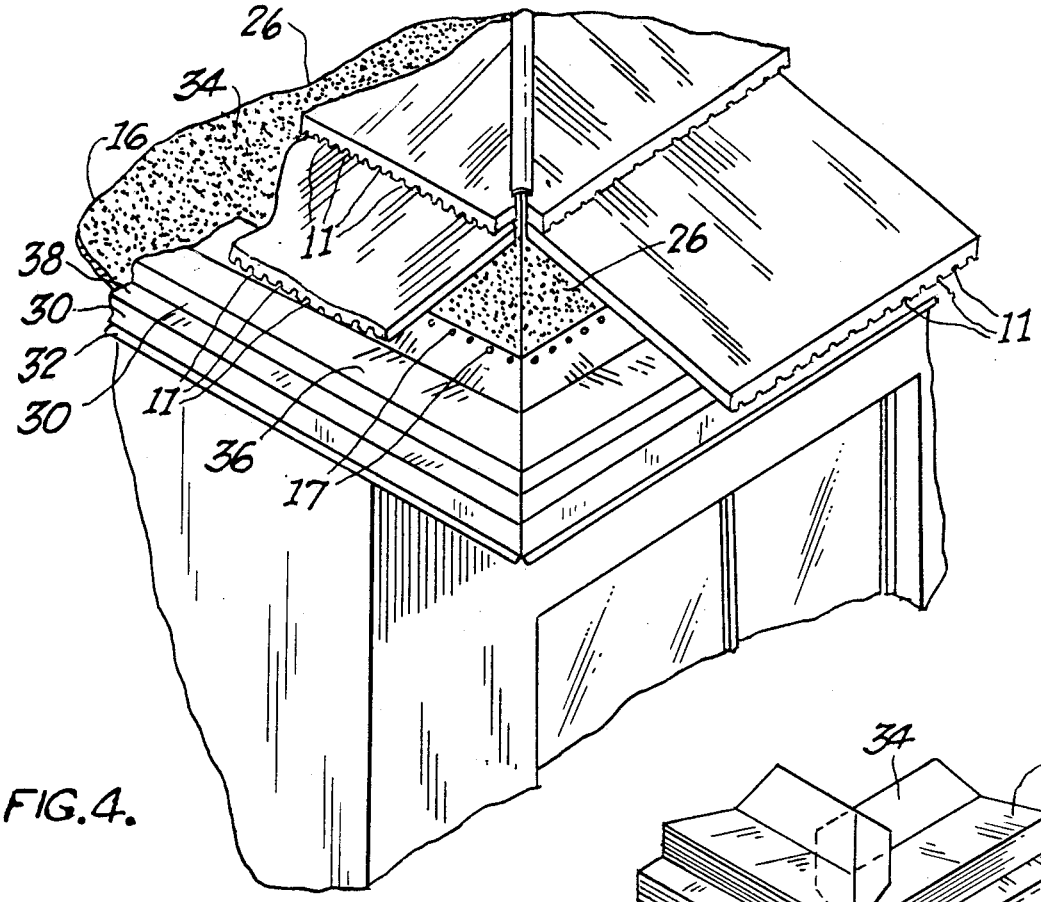
FIG. 4 is a representative illustration of the anti-ponding riser and edge flashing of the instant invention applied to a structure.
Figure 5:
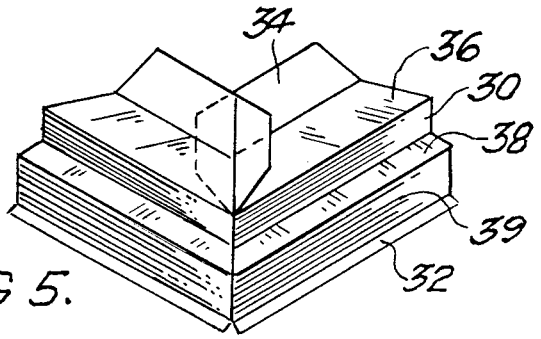
FIG. 5 shows a perspective view of the article of the instant invention configured to conform to an angled roof pitch intersection.

FIG. 4 shows a representative illustration of article 29 applied to a structure 50 having a roof 48 as shown. As can be appreciated from FIG. 4, a continuous length of anti-ponding member 29 is connected to the structure. Water running off of the roof system 48 from underneath the roof tiles 10 thereof will, as in FIG. 2, flow over waterproof material 26 onto first roof decking connection member, or nail strip, 34, over sloped or ramped portion 36, under eave course roof tiles 10 by passing through ridges 11 thereunder, down riser member 30, over second roof decking connection member 38, down flashing 39 and off of eave drip member 32.

The anti-ponding riser 29 of the instant invention is preferably connectable to the roof decking material 16 using nails 17 in conventional fashion. It is to be further appreciated that the waterproof underlayment material 26 may overlay or underlay the first roof decking connection member 34, alternatively referred to as the first base segment or nail strip as desired. In the preferred embodiment, however, the waterproof underlayment material 26 overlays the nail strip 34 and the ramp section 36 so as to provide a continuous path for the drainage of water from under the roof tiles to the eave flashing 39 and eave drip member 32. As it is customary to use a lighter underlayment material 26, such as tar paper (e.g.: 30 lbs.) covered by a second, heavier, underlayment material 27, such as tar paper (e.g.: 90 lbs.), the lighter paper 26 may be laid under the article 29 and the heavier paper laid over article 29 as shown in FIG. 2. Securement means 17 may also be punched through second roof decking connection member, or second base segment, 38 as desired.

As can be appreciated from the foregoing, the preferred embodiment of the instant invention provides a continuous and relatively smooth path for runoff water to be carried from underneath the tiles of a tile roof system away from the eave or facia thereof.

The instant invention has been shown and described herein in what it is considered to be the most practical and preferred embodiment. It is recognized, however, that departures may be made therefrom within the scope of the invention and that obvious modifications will occur to a person skilled in the art.

I claim:

1. In a tile roof the type comprising a sheathing, a waterproof underlayment disposed upon the sheathing, a covering of tiles disposed atop the underlayment such that nose ends of the tiles rest upon the head ends of the next lower tiles, a combination riser and eave drip member extending along the eave course to support the nose ends of the eave course tiles at a predetermined height and to provide a means for draining runoff water running beneath said covering of tiles, comprising:

a base portion connected atop said sheathing in coplanar fashion;

a riser member extending generally upwardly from said base portion adapted to support the nose ends of the eave course tiles;

an eave flashing member extending generally below said base portion and spaced from said riser portion, said eave flashing member covering at least a portion of the eave;

said eave flashing member having a drip member projecting generally outwardly from said eave to direct runoff water away from said eave;

said riser and eave drip member being constructed of a continuous sheet of rigid material;

said riser member separating said base member into a first base segment and a second base segment, said riser member sloping gently, to allow water to flow thereover due to gravity, from said first base segment to a point of interconnection between said eave course tiles and said riser member, said riser member thereafter angled sharply downwardly between said gently sloping portion and said second base segment, said first and second base segments being generally coplanar and connected to said waterproof underlayment.

2. In a tile roof system of the type comprising a roof decking, a waterproof underlayment disposed upon the decking, a covering of tiles disposed atop the underlayment such that nose ends of the tiles rest upon the head ends of the next lower tiles, a combination riser and eave drip member adapted to be mounted to the roof system near the roof decking/eave interface, said combination comprising:

a base member comprised of a first decking connection member and a second decking connection member;

a riser means integrally connected between said first and second decking connection members;

an eave flashing member integrally connected to said second decking connection member at a point remote from said riser means;

an eave drip member integrally connected to said eave flashing member at a point remote from said second decking connection member;

said combination being arranged such that water running below said covering of tiles and above said waterproof underlayment will flow from said waterproof underlayment smoothly onto and over said riser means and thereafter run over said second decking connection member, down said eave flashing member and off of said eave drip member;

said eave drip member projecting generally outwardly from said decking/eave interface so as to divert water away from said eave.

3. The combination of claim 2, wherein said riser means is comprised of:

a roof tile support section;

a first gently sloping runoff segment disposed between said roof tile support section and said first roof decking connection member;

a second runoff section connected between said roof tile support section and said second decking connection member, said second runoff section disposed at an angle of less than ninety degrees relative to said first runoff section.

* * * * *